US005535790A

United States Patent [19]

Hirz

[11] Patent Number: 5,535,790

[45] Date of Patent: Jul. 16, 1996

[54] PRESSURIZED CAN FILLING APPARATUS

[76] Inventor: Donald J. Hirz, 835 Charles St., Willowick, Ohio 44095

[21] Appl. No.: 265,330

[22] Filed: Jun. 24, 1994

[51] Int. Cl.[6] ..... B65B 3/04

[52] U.S. Cl. ..... 141/20; 141/97; 141/369; 141/378

[58] Field of Search ..... 141/3, 20, 97, 141/25, 27, 275, 369–371, 378

[56] References Cited

U.S. PATENT DOCUMENTS

| | | | |
|---|---|---|---|
| 2,914,096 | 11/1959 | Foresman, Jr. | 141/20 |
| 3,335,765 | 8/1967 | Moonan | 141/20 |
| 3,595,340 | 6/1971 | Obergefell et al. | 184/27 |
| 3,797,534 | 3/1974 | Skidmore | 141/3 |
| 4,321,953 | 3/1982 | Grothoff | 141/3 X |
| 4,632,281 | 12/1986 | Wold | 222/389 |
| 4,938,260 | 7/1990 | Hirz | 141/20 |
| 5,333,660 | 8/1994 | Kohlmann et al. | 141/25 X |

*Primary Examiner*—J. Casimer Jacyna
*Attorney, Agent, or Firm*—Pearne, Gordon, McCoy & Granger

[57] ABSTRACT

An apparatus for filling a pressurized can is provided that includes a pumping assembly having a piston for driving a liquid into the can. A cabinet encloses the pumping assembly and has a door which provides access to the pumping assembly. A first embodiment of the apparatus includes a manual lever arm assembly for driving the pumping assembly. A second embodiment of the apparatus includes a powered pneumatic cylinder for driving the pumping assembly and a control circuit for cycling the pneumatic cylinder. Preferably the control circuit includes a control valve for alternately supplying pneumatic fluid to upper and lower spaces of the pneumatic cylinder and a pair of accumulators for alternating the control valve. A third embodiment of the apparatus includes automatic means controls for driving the pumping assembly a selected number of piston cycles. Preferably, the automatic controls includes a stroke counter for counting the number of piston cycles and a shut-off valve triggered by the stroke counter to stop cycling of said piston when a predetermined number of piston cycles has been counted. Kits are provided for progressively upgrading the apparatus of the first embodiment to the apparatus of the third embodiment. Therefore, each cabinet is manufactured with openings for mounting the pneumatic cylinder and the automatic controls.

21 Claims, 7 Drawing Sheets

Fig.3
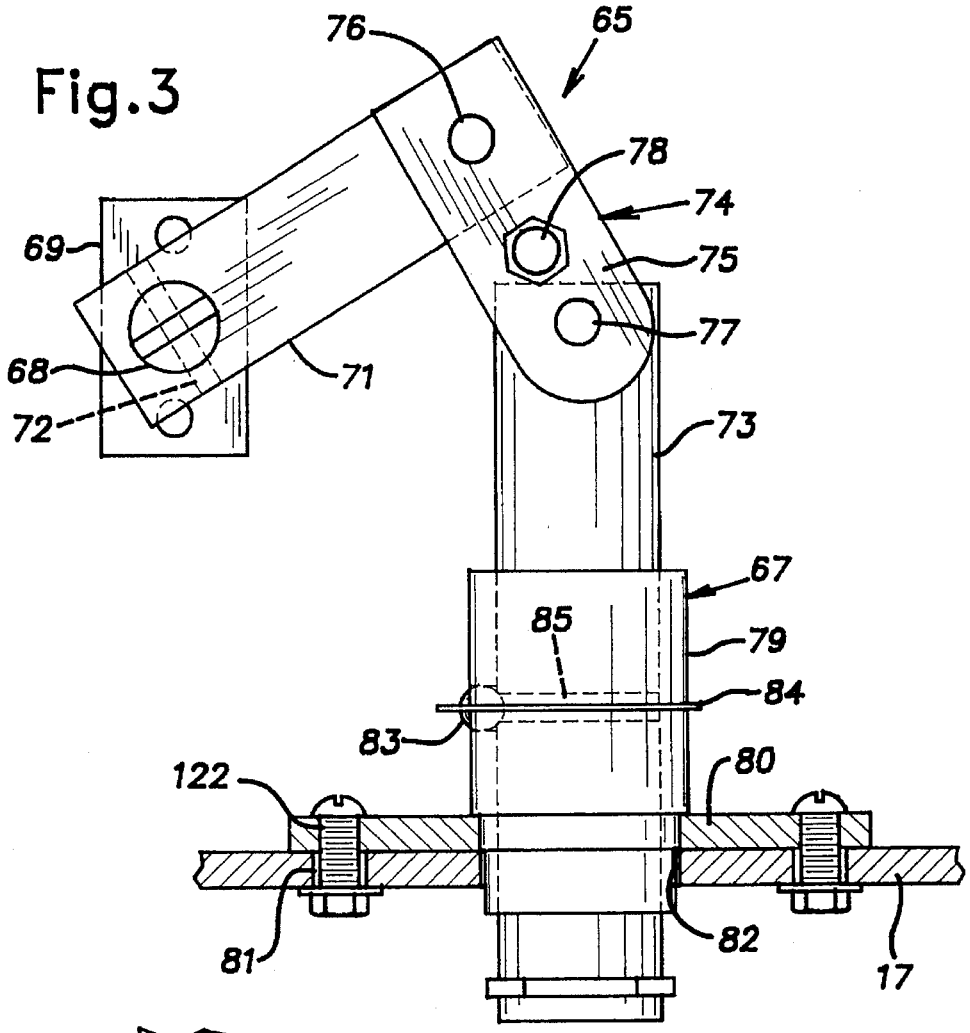
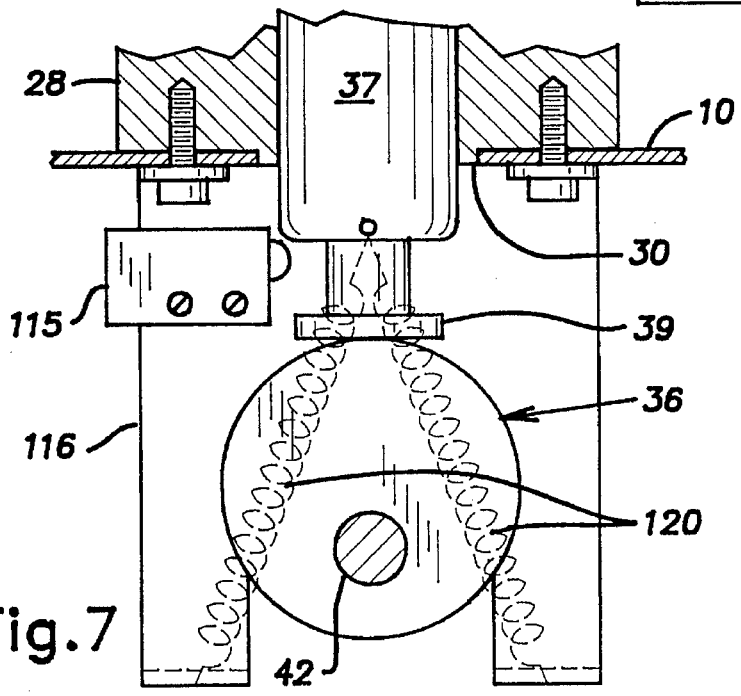
Fig.7

PRESSURIZED CAN FILLING APPARATUS

BACKGROUND OF THE INVENTION

1. Field of the Invention

The invention generally relates to apparatus for filling pressurized containers, and more particularly to apparatus for injecting fluids, such as paints and lacquers, into cans which have been previously charged with fluid propellants and solvent.

2. Description of Related Art

Machines for injecting paint and the like into precharged aerosol cans have been available. For example, U.S. Pat. No. 3,797,534, which is hereby incorporated in its entirety by reference, discloses a device having a manual lever for raising a can to be charged into contact with a paint reservoir. A pneumatically operated piston drives the paint from a cylinder at the bottom of the reservoir through the aerosol valve into the can. Due to the tubular or skeletal frame, however, operators of such machines may be poorly protected from pressurized leaks. Additionally, many of the moving components are not protected from spilled paint which can cause damage by blocking or clogging the components.

Machines having cabinets enclosing the can filling operation have also been disclosed. For example, U.S. Pat. No. 4,938,260, which is hereby incorporated in its entirety by reference, discloses a device having a cast base and rigid side plates forming a cabinet. The device includes pneumatic means for raising the can and a pneumatically operated piston which drives the paint into the can. Such machines can require relatively complex and expensive pneumatic circuits and cabinet structures. Therefore, such machines can be relatively expensive to produce.

SUMMARY OF THE INVENTION

The present invention provides an apparatus for filling a pressurized can that avoids the high costs associated with the prior art machines. The apparatus includes a pumping assembly having a piston, a pumping chamber adapted for receiving the piston, and a reservoir. The pumping chamber has an outlet adapted for sealing engagement with the can. The reservoir supplies a liquid to the pumping chamber and the piston drives the liquid through the outlet and into the can. A cabinet encloses the pumping assembly and has a door which provides access to the pumping assembly. Preferably the cabinet has three sides formed from a single steel sheet.

A first embodiment of the apparatus includes manual means for driving the pumping assembly such as a lever arm assembly. A second embodiment of the apparatus includes powered means for driving the pumping assembly such as a pneumatic cylinder and means for cycling the pneumatic cylinder. Preferably the cycling means includes a control valve for alternately supplying pneumatic fluid to upper and lower spaces of the pneumatic cylinder and a pair of accumulators for alternating said control valve. A third embodiment of the apparatus includes automatic means for driving the pumping assembly. Preferably the automatic driving means includes a stroke counter for counting the number of piston cycles and a shut-off valve triggered by said stroke counter to stop cycling of said piston when a predetermined number of piston cycles has been counted. The third embodiment also includes a valve located in the base which senses an overfilled can (such overfilled cans expand in length) and shuts off the pumping operation.

According to the invention, kits are provided for progressively upgrading the apparatus of the first embodiment to the apparatus of the third embodiment. Therefore, each cabinet preferably includes means for mounting powered driving means and automatic driving means.

BRIEF DESCRIPTION OF THE DRAWINGS

These and other features and advantages of the present invention will be apparent with reference to the following description taken in conjunction with the accompanying drawings, wherein:

FIG. 3 is a fragmentary side elevational view of a lever arm assembly;

FIG. 7 is a fragmentary elevational view of a limit sensor valve mounted within a base.

DETAILED DESCRIPTION OF THE PREFERRED EMBODIMENTS

Figure 1:
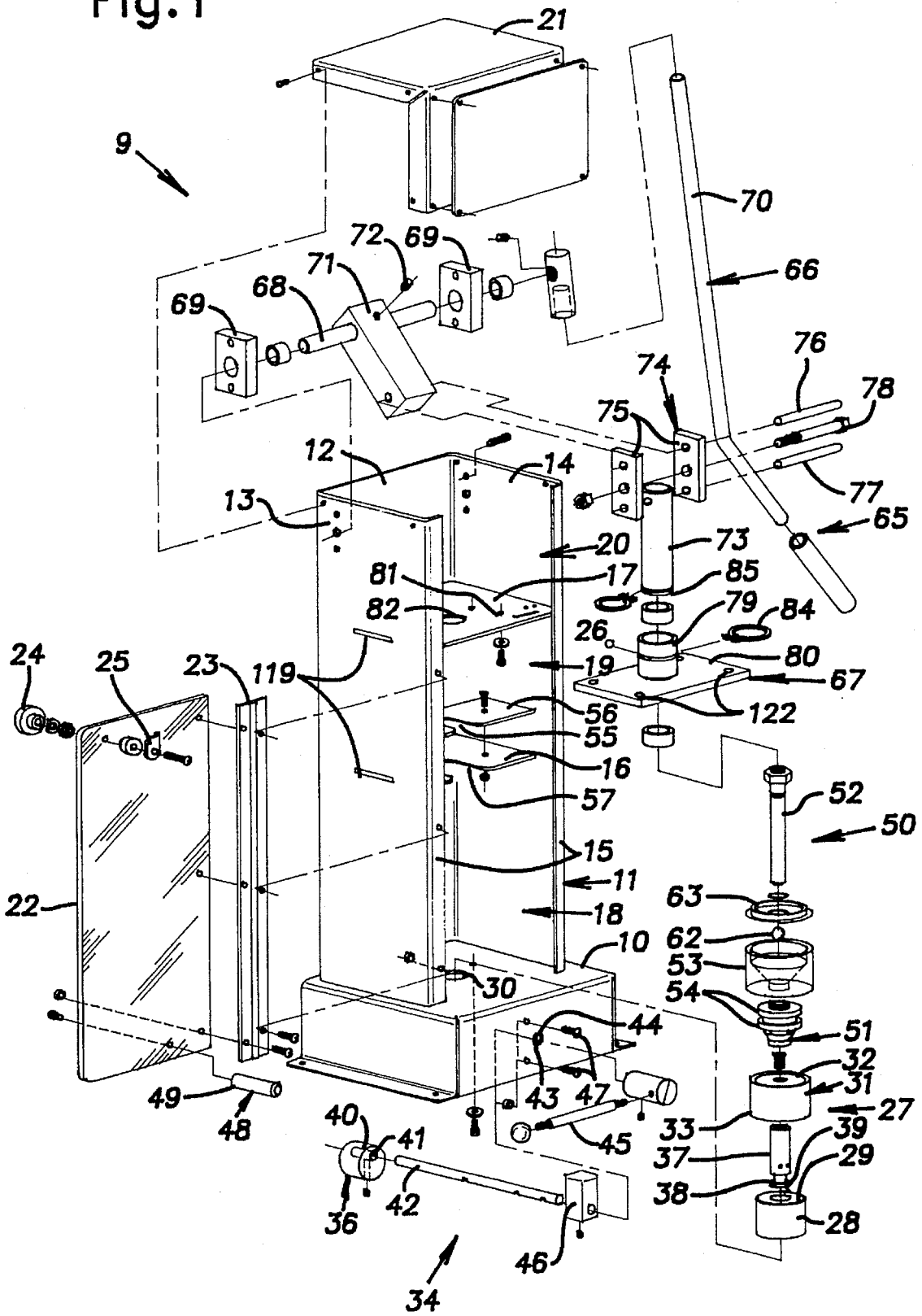
FIG. 1 is an exploded perspective view of an apparatus for filling pressurized cans in accordance with a first embodiment of the invention.

An apparatus 9 for filling pressurized containers or cans according to the present invention is shown in FIG. 1. The apparatus 9 includes a frame formed of a base 10 and a cabinet 11 mounted on the base 10. The base 10 is preferably fabricated as a box-like structure having a hollow interior by forming mild steel sheet metal, and welding the seams. The cabinet 11 is also preferably fabricated by forming mild steel sheet metal and includes, from a single steel sheet, a back wall 12, side walls 13, 14, and front flanges 15 forming a front opening. A middle or reservoir support plate 16 and an upper support plate 17 divide the cabinet into a can receiving region 18, a reservoir or pumping region 19, and a driving region 20. The middle and upper support plates 16, 17 are vertically positioned by tabs extending through openings 119 in the side walls 13, 14 and are welded to the cabinet side walls 13, 14. The cabinet 11 extends upwardly from the base 10 and preferably has integral depending tabs extending through slots in the base 10. The tabs received in the interior of the base 10 are bent to fix the cabinet 11 to the base 10. The tabs reduce cost by eliminating fasteners and also allow the cabinet and base to be painted or coated prior to assembly by eliminating a welded joint.

The cabinet also includes a top cover 21 and a door 22. The top cover 21 is preferably formed of sheet metal and has a top portion to close the top of the cabinet 11 and a front portion to close the front of the driving region 20. The top cover 21 is attached to the cabinet 11 by sheet metal screws. The door 22 is fastened to a hinge 23 which is fastened to one of the front flanges 15 of the cabinet 11 by machine screws and nuts. The door 22 selectively closes the can receiving region 18 and the pumping region 19. The door 22 is preferably constructed of a transparent and solvent resisting material, such as a transparent plastic, for example a polycarbonate with a scratch resistant coating. The door 22 is preferably transparent to allow the operator to observe the can receiving and pumping regions 18, 19 during the filling operation. The door 22 is preferably solvent resisting so that the door 22 does not become dull or clouded when cleaned with solvents or thinners. The door 22 has a rotatable handle 24 having a latch 25 which engages a slot 26 in the upper support plate 17 to secure the door 22 in the closed position.

A can supporting assembly 27 includes a cylindrically shaped guide bushing 28 which upwardly extends from the base 10 and has an axially extending opening 29 generally concentric with an opening 30 in the base 10. The guide bushing 28 is preferably fabricated from aluminum and is attached to the base 10 by machine screws. The can supporting assembly 27 also includes a can support platform 31 which has a can supporting surface 32 and a downwardly extending integral skirt 33. The skirt 33 is dimensioned for close fitting coverage of the guide bushing 28, whereby the guide bushing 28 is slidably received within the skirt 33. The can support platform 31 is selectively raised and lowered between a can filling or raised position and a can inserting and removing or lowered position. The vertical extension of the skirt 33 and guide bushing 28 are such that the skirt 33 continues to telescope with the guide bushing 28 when the can support platform 31 is in the raised position.

Means 34 for elevating the can support platform 31 includes a platform shaft 35 and a cam 36. The platform shaft 35 has spring loaded and telescopically arranged outer and inner members 37, 38. The outer member 37 downwardly extends from the can support platform 31 through the skirt 33 and is attached to the can support platform 31 by a flat head machine screw extending through an opening in the can supporting surface 32. The outer member 37 is upwardly or axially biased by a spring element (not shown), such as a helical coil compression spring, located within the outer member 37. When assembled, the spring element of the preferred embodiment yields under a compression force of approximately 50 lbs on the can support platform 31. The inner member 38 is permanently assembled with the outer member 37 so that the precompressed spring cannot be accidentally released. An outer or lower end 39 of the inner member is adapted for following the cam 36.

The cam 36 has a generally cylindrical outer surface 40 about a central axis and an opening 41 about an axis extending generally parallel to and offset from the central axis. A cam shaft 42 extends through the opening 41 in the cam 36 and locates the cam 36 below the opening 30 in the base 10 such that the lower end 39 of the platform shaft inner member 38 engages the outer surface 40 of the cam 36. The cam shaft 42 is rotatably supported within bushings 43, welded to opposite ends of the base 10, and extends through an opening 44 in the front end of the base 10.

A handle or lever arm 45 is located at an outer end of the cam shaft 42 for rotating the cam shaft 42. In the preferred embodiment, the lever arm 45 horizontally extends to the left of the cam shaft 42 (as viewed from the front of the base) when the cam 36 is oriented to position the can support platform 31 in the lowered position. Rotation of the lever arm 45 for 180 degrees orients the cam 36 to position the can support platform 31 in the raised position. A stop 46 is located on the cam shaft 42 within the base 10 and adjacent the opening 44 in the base 10 to limit outward translation of the cam shaft 42. The stop 46 also limits rotation of the cam shaft 42 when the stop 46 engages limit elements 47. The limit elements 47 of the preferred embodiment comprise screws extending through the front end of the base 10. The limit elements 47 are positioned such that rotation of the cam shaft 42 is limited to a clockwise upward rotation to move the can support platform 31 from the lowered position to the raised position, and a counter-clockwise upward rotation to move the can supporting platform 31 from the raised position to the lowered position. The cam 36, the lever arm 45, and the stop 46 are fixed to the cam shaft 42 by set screws.

A mechanical interlock 48 prevents the door 22 from closing when the can support platform 33 is in the lowered position. The mechanical interlock 48 includes a cylindrically shaped finger 49 inwardly extending from a lower portion of the door 22. The finger 49 is attached to the door 22 by a machine screw extending through an opening in the door the door 22. The finger 49 is dimensioned and positioned such that the finger 49 engages the skirt 33 of the can support platform 31 to prevent the door 22 from closing when the can support platform 31 is in the lowered position. The finger 49 is also dimensioned and positioned, however, such that the finger 49 avoids engagement of both the skirt 33 and the guide bushing 28 to allow the door 22 to close when the can support platform 31 is in the raised position.

A pumping assembly 50 is provided and includes a can receiver 51, a piston 52, and a liquid reservoir 53. An outer surface of the can receiver 51 has a pair of parallel radially extending flanges 54 such that the can receiver 51 can be horizontally inserted and axially retained within an elongated opening 55 of a locator or stiffener plate 56. The stiffener plate 56 is attached to the middle support plate 16 which has an elongated opening 57 sized to clear the can receiver 51 and allows the can receiver 51 to extend between the can receiving region 18 and the pumping region 19. The stiffener plate 56 is attached in a manner such that the can receiver 51 can be adjusted to be generally coaxial with the can supporting assembly 27.

Figure 2:
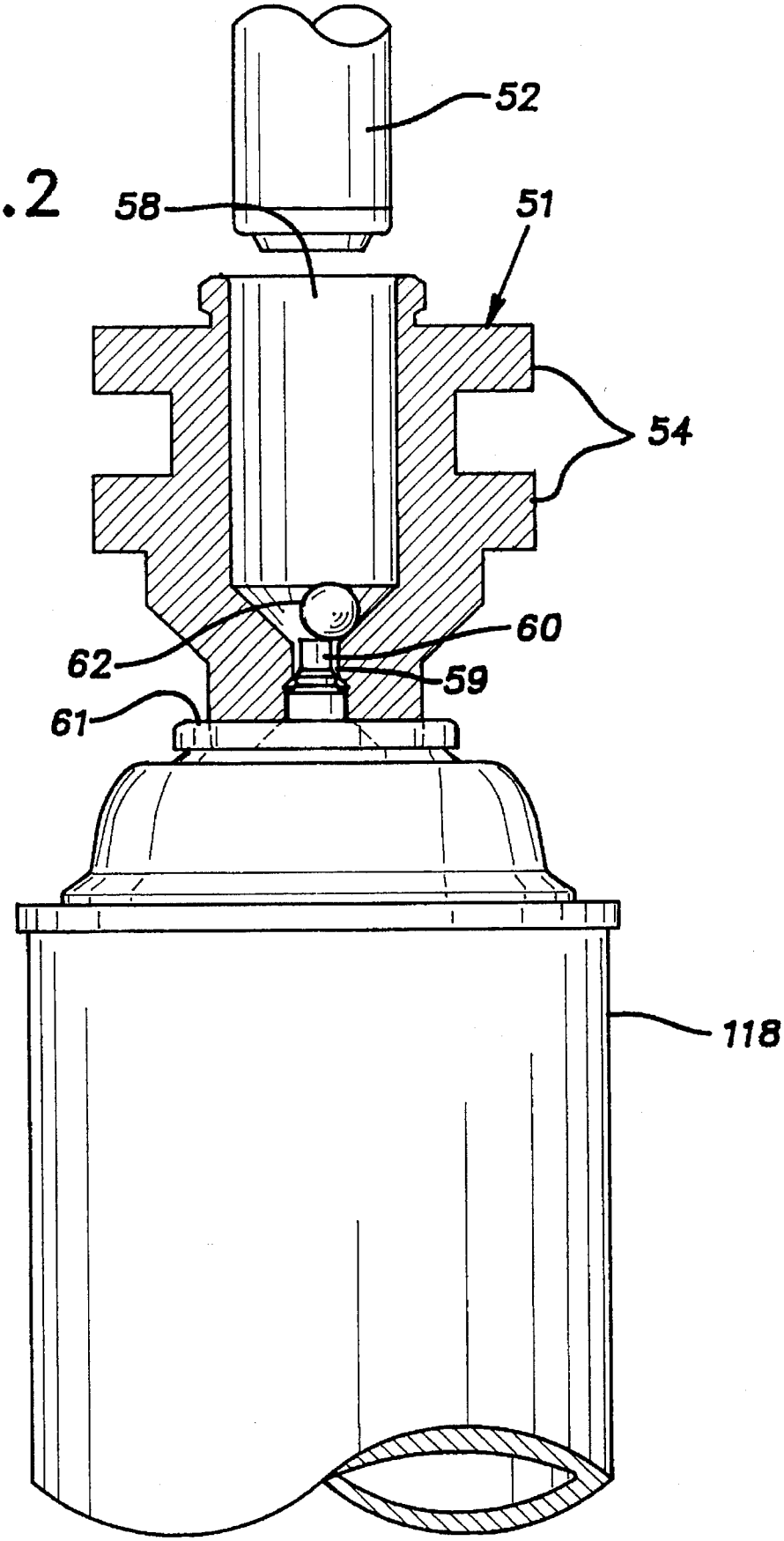
FIG. 2 is a partial elevational view, in partial cross-section, of a can engaging a can receiver.

As best seen in FIG. 2, a pumping chamber or cylinder 58 is defined within the can receiver 51 and has an outlet 59 at the lower end of the can receiver 51. The outlet 59 is configured to be engaged in a liquid tight seal by a valve 60 and upper surface 61 of a pressurized can 118 when the can support platform 31 is in the raised position. It will be noted that the spring loaded platform shaft 35 limits force between the outlet and the pressurized can to provide a liquid tight seal without damaging the pressurized can. A check ball 62 is provided to prevent liquid from flowing through the outlet 59 when the can valve 60 is not in the outlet 59. The piston 52 is adapted in a conventional manner to cooperate with the pumping chamber 58 for filling a pressurized can when the piston 52 is axially stroked or moved within the pumping chamber.

The liquid reservoir 53, for example a one quart reservoir, is threadably attached to the upper end of the can receiver 51 and is adapted to fill the pumping chamber 58 with liquid when the piston 52 exits the pumping chamber 58. The reservoir 53 is preferably provided with a removable lid 63 having an opening 64 for receiving the piston 52. The lid 63 discourages evaporation of the liquid in the reservoir 53 and minimizes spilling or splashing of the liquid during the filling operation. It will be noted that liquid reservoirs of a larger size can be utilized for filling a quantity of pressurized cans.

The apparatus 9 also includes manual means 65 for operating or driving the pumping assembly 50. The manual driving means 65 includes a lever assembly 66 and a guide assembly 67. The lever assembly 66 includes a shaft 68 extending between the side walls 13, 14 at an upper rear portion of the driving region 20 and has an outer end extending through an opening in one of the side walls 14. The shaft 64 is rotatably supported by pillow blocks 69 attached to the side walls 13, 14 by machine screws. Preferably, the pillow blocks 69 include bronze bushings to provide an improved wear surface. At the outer end of the shaft 68 a lever or crank arm, or handle 70 is attached with a taper pin. A connector arm or yoke member 71 forwardly extends from a central portion of the shaft 68. The shaft 68 extends through an opening in the yoke member 71 and is rigidly fixed to the yoke member 71 by a taper pin 72 extending perpendicularly to the axis of the shaft 68 through openings in the yoke member 71 and shaft 68.

As best seen in FIG. 3, an upper end of a piston shaft 73 is connected to the forward end of the yoke member 71 by a linkage assembly 74. The linkage assembly 74 includes a pair of side plates 75 located on opposite sides of the yoke member 71. A first dowel pin 76 laterally extends through an opening in the yoke member 71 having a press fit and openings in the side plates 75 having a clearance fit. A second dowel pin 77 laterally extends through an opening in the piston shaft 73 having a press fit and openings in the side plates 75 having a clearance fit. A bolt 78 having a nylon lock-nut extends through bolt holes in a central portion of the side plates 75 to retain the side plates 75 on the dowel pins 76, 77. The lower end of the piston shaft 73 threadably attaches to an upper end of the pumping assembly piston 52. It will be noted that piston shaft 73 and piston 52 are coaxial and also that the piston 52 could be integral with the piston shaft 73.

The guide assembly 67 includes a cylindrically-shaped guide 79 having a bore sized for guiding the piston shaft 73. The guide 79 is attached, preferably by welding, to a center portion of a plate 80. Preferably, the guide 79 includes a bronze bushing to provide a good wear surface. The plate 80 has an opening in the central portion that is generally in alignment with the bore of the guide 79. The plate 80 is attached to the upper support plate 17 by machine screws extending upwardly through screw holes 81 in the upper support plate 17 and into threaded holes 122 in the plate 80. The upper support plate 17 has an opening 82 that is generally in alignment with the bore of the guide 79. The screw holes 81 in the upper support plate 17 are preferably four in number, are symmetrically arranged about opening 82, and are dimensioned with clearance such that the guide 79 can be adjusted to be coaxial with the can supporting assembly 27 and the pumping assembly 50. The threaded holes 122 in the plate 80 are arranged to match the screw holes 81 in the upper support plate 17.

The guide assembly 67 also includes a detent means for releasably securing the piston shaft 73 in a raised position. The detent means includes a spring clip 84, attached to the guide 79, which inwardly biases a ball 83 against the piston shaft 73 through an opening in the side of the guide 79. When the piston shaft 73 is in the raised position, the ball 83 engages a groove 85 in the piston shaft 73. The groove 85 is formed to secure the piston shaft 73 in the raised position until an adequate force for overcoming the bias of the spring clip 84 is applied to force the ball 83 out of the groove 85.

To fill a pressurized can with a liquid such as paint, the liquid reservoir 53 is filled with at least a quantity of paint for filling a single can. With the door 22 open and the can supporting assembly 27 in the lowered position, the can is positioned on the can supporting surface 32 of the can support platform 31. The handle 45 is then rotated clockwise until the stop 46 engages the limit element 47. Rotation of the handle 45 rotates the cam shaft 42 and cam 36. As the cam 36 rotates the can supporting assembly 27 is raised to the raised position as the lower end 39 of the platform shaft inner member 38 follows the outer surface 40 of the cam 36. In the raised position the valve and upper surface of the can engages the outlet 59 of the can receiver 51 in a liquid tight seal and the check ball 58 is unseated. Once the can is in the raised position the door 22 is closed and secured.

The operator applies a downward force on the handle 70 which rotates the shaft 68 and yoke member 71. As the yoke member 71 downwardly rotates, the piston shaft 73 is forced downwardly and moves the piston 52 into the pumping chamber 58. Downward movement of the piston drives the paint in the pumping chamber 58 into the can. The operator then applies an upward force to the handle 70 to move the piston 52 out of the pumping chamber 58 to complete a piston cycle. As the piston 52 exits the pumping chamber 58 the paint in the liquid reservoir 53 refills the pumping chamber. Additional piston cycles are continued until the can has been filled with the required amount of paint.

Figure 4:
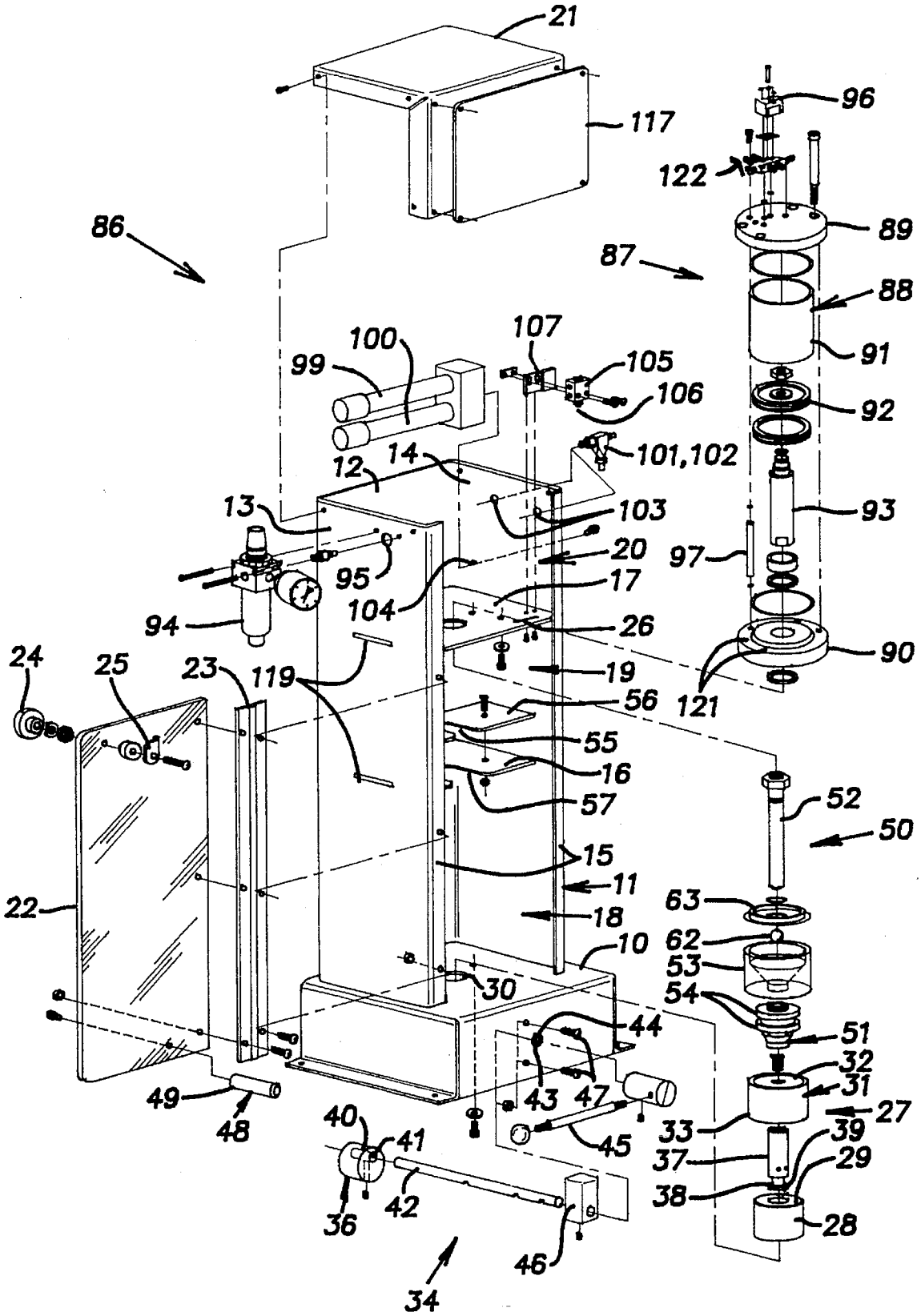
FIG. 4 is an exploded perspective view of an apparatus for filling pressurized cans in accordance with a second embodiment of the invention.

A second embodiment of the present invention is shown in FIG. 4. The apparatus 86, with the exception of substitute and additional parts to be described, has essentially the same construction as that described above for the apparatus 9 of FIG. 1. The apparatus 86 includes powered or semi-automatic means 87 for operating or driving the pumping assembly 50. The powered driving means 87 includes a double acting pneumatic cylinder 88 and means 122 for cycling the pneumatic cylinder 88.

The pneumatic cylinder 88 has a top cap 89 and a bottom cap 90 generally sealably closing a housing 91. A piston 92 is provided within the housing 91 to form upper and lower spaces and is attached to a piston rod 93 that sealingly extends through an opening in the bottom cap 90. A manifold formed in the top cap 89 communicates with the upper space and in conjunction with a manifold formed in the bottom cap 90 and a brass tube 97 communicates with the bottom space. The bottom cap 90 is attached to the upper support plate 17 by machine screws extending upwardly through the screw holes 81 in the upper support plate 17 and into threaded holes 121 in the bottom cap 90. The threaded holes 121 are arranged to match the screw holes 81 in the upper support plate 17. The piston rod 93 extends through the opening 82 in the upper support plate 17 and, at a lower end, is attached by complimentary threads to an upper externally threaded end of the pumping assembly piston 52. The screw holes 81 in the upper support plate 17 are dimensioned with clearance such that the pneumatic cylinder 88 can be adjusted to be coaxial with the can supporting assembly 27 and the pumping assembly 50.

The means 122 for cycling the pneumatic cylinder 88 includes a control valve 96 having two outlet ports, such as a spool valve, and timing means for alternating between the outlet ports of the control valve 96. The control valve 96 is attached to the top cap 89 of the pneumatic cylinder 88. The timing means includes two accumulators 99, 100 and two needle valves 101, 102. Two needle valves 101, 102, each associated with one of the accumulators 99, 100, extend through openings 103 in the side wall 14. The accumulators 99, 100 are preferably tubes, such as PVC tubes, each having caps at one end and a common block at the other end. The common block has separate bores for accepting the tube ends. The two accumulators 99, 100 have no connecting passage ways. Inlet and outlet ports extend through a side of the block and are in communication with an interior of an associated tube. The accumulators 99, 100 are attached to the cabinet 11 by a sheet metal screw extending through an opening 104 in the cabinet side wall 14 adjacent the driving region 20.

An air regulator 94 is attached to an outer surface of the side wall 13 adjacent the driving region 20 with sheet metal screws. An inlet of the regulator is connected to a standard line (not shown) supplying compressed air. A fitting on an outlet of the regulator 94 extends through an opening 95 in the side wall 13.

An interlock means or safety/start valve 105 is provided that allows air to pass only when a plunger 106 is engaged. The safety/start valve 105 is located adjacent the slot 26 in the upper support plate 17 such that the door latch 25 engages and cams the plunger 106 upwardly when the door 22 is latched. However, if the door 22 is unlatched the plunger 101 is disengaged preventing air from passing through the safety/start valve 105. An adjustable mounting bracket 107 for mounting the safety/start valve 105 is attached by machine screws extending through openings 108 in the upper support plate 17.

Figure 5:
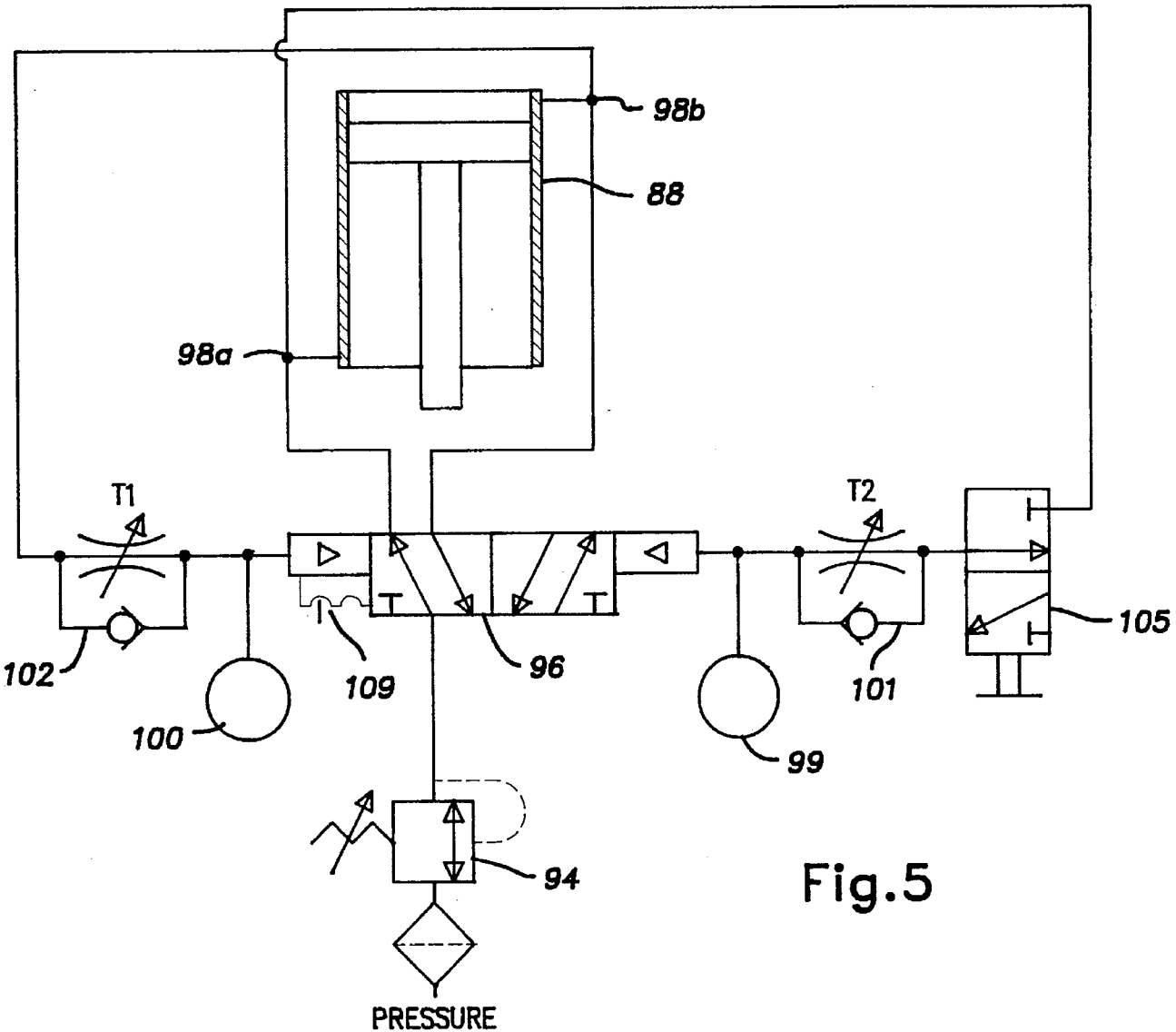
FIG. 5 is a diagrammatic illustration of a pneumatic circuit for the apparatus of FIG. 4.

A diagrammatic illustration of a pneumatic circuit for the apparatus 86 is shown in FIG. 5. The outlet fitting of the regulator 94 is in communication with the control valve 96. The first outlet port of the control valve 96 supplies air to the lower space of the pneumatic cylinder 88, for driving the piston 92 upwardly. A first T-connector **98*a* bleeds off a portion of the air supplied from the first outlet port of the control valve 96 to an inlet port of the safety/start valve 105. The outlet port of the safety/start valve 105 is in communication with the inlet port of the first accumulator 99 via the first needle valve 101**.

The outlet port of the first accumulator 99 is in communication with the control valve 96 for shifting the spool to communicate the second outlet port of the control valve 96 with the upper space of the pneumatic cylinder 88.

The second outlet port of the control valve 96 supplies air to the upper space of the pneumatic cylinder 88, for driving the piston downwardly. A second T-connector **98*b* bleeds off a portion of the air supplied from the second outlet port of the control valve 96 to the inlet port of the second accumulator 100 via the second needle valve 102. The outlet port of the second accumulator 100 is in communication with the control valve 96 for shifting the spool to communicate the first outlet port of the control valve 96 with the lower space of the pneumatic cylinder 88**.

To fill a pressurized can with paint, the reservoir is filled with paint, the can is positioned and raised, and the door is closed and secured as described above in connection with the apparatus 9 of FIG. 1. The air regulator 94 supplies air at the required pressure to the control valve 96. The air flows from the first outlet port of control valve 96 to the lower space of the pneumatic cylinder 88 and forces the piston 92 and piston rod 93 upward to a fully raised position. A portion of the air from the control valve 96 is bled to the first accumulator 99 by the T-connector **98*a*. When the first accumulator 99 reaches a predetermined air pressure, for example 10 psi, the air pressure shifts the control valve 96 so that the air flows from the second outlet port of the control valve 96 to the upper space of the pneumatic cylinder 88 and forces the piston 92 and piston rod 93 downward while the first accumulator 99** is exhausted through the outlet.

The movement of the piston rod 93 downwardly moves the piston 52 into the pumping chamber 58 to force liquid from the reservoir 53 into a can. A portion of the air from the second outlet port of the control valve 96 is bled to the second accumulator 100 by the T-connector **98*b*. When the second accumulator 100 reaches a predetermined air pressure, the air pressure trips the control valve 96 so that the supply air again flows from the first outlet of the control valve 96 to the lower space of the pneumatic cylinder 88. The cycling of the piston continues until the door handle is unlatched to shift the safety/start valve 105 and interrupt communication between the first outlet port of the control valve 96 and the first accumulator 99. Once communication with the first accumulator 99 is interrupted, the control valve 96 continues to supply air to the lower space of the pneumatic cylinder 88 and cycling of the piston 52 is stopped. A detent assembly 109 of the control valve 96 insures that the control valve 96** is not arbitrarily triggered.

It should be noted that the length of each piston stroke is controlled by the time required for the accumulators 99, 100 to reach the predetermined pressure. Therefore, to account for varying properties of the paint, such as viscosity, the time can be adjusted to ensure the piston moves a complete stroke. The time is adjusted by adjusting the needle valves 101, 102 to throttle the air which is bled to the accumulators 99, 100.

Figure 6:
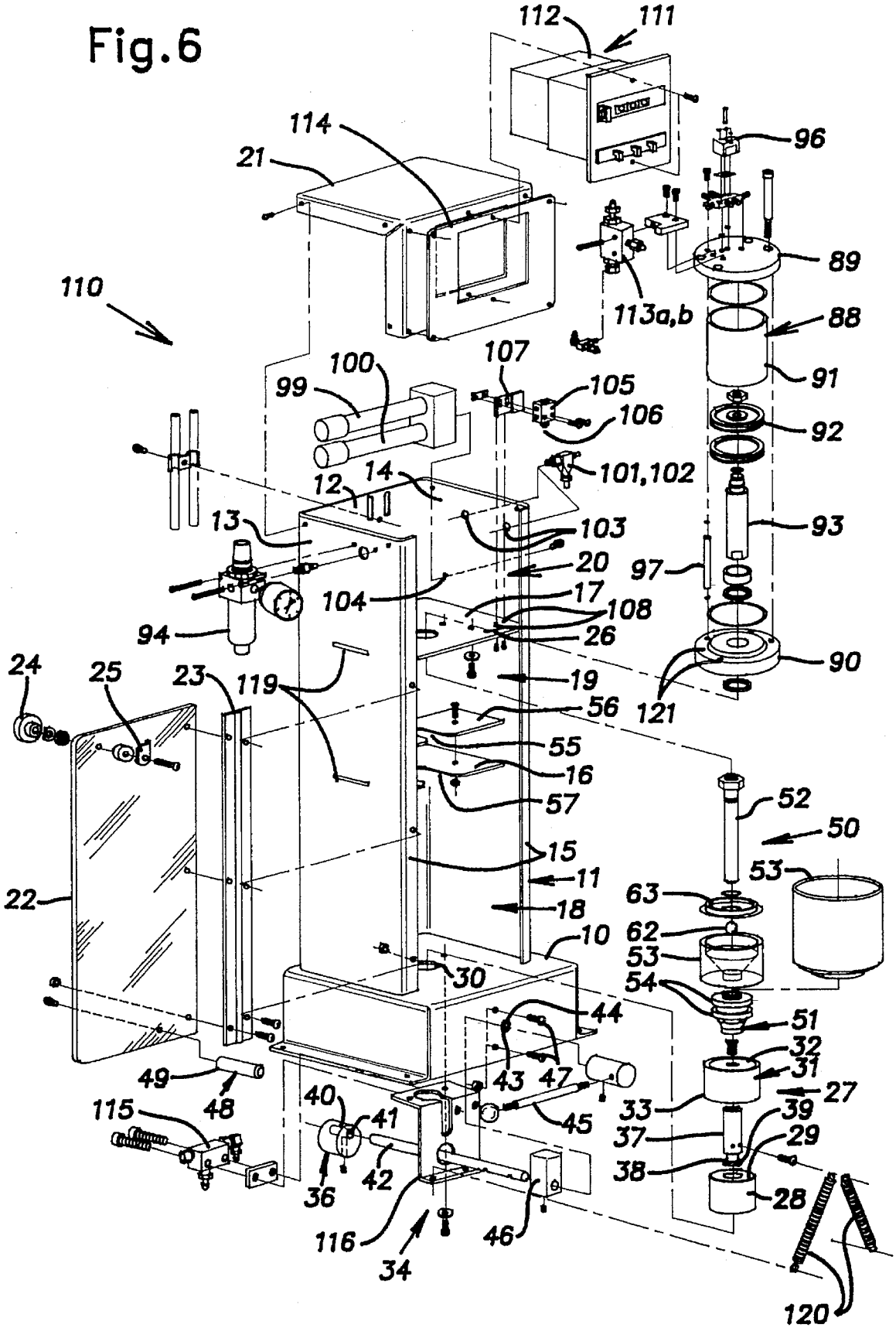
FIG. 6 is an exploded perspective view of an apparatus for filling pressurized cans in accordance with a third embodiment of the invention.

A third embodiment of the present invention is shown in FIG. 6. The apparatus 110, with the exception of substitute and additional parts to be described, has essentially the same construction as that described for the apparatus 86 of FIG. 4. The apparatus 110 includes automatic means 111 for operating or driving the pumping assembly 50.

The automatic driving means 111 includes a commercially available pneumatic stroke counter 112, a shut-off valve assembly comprising a pair of shuttle valves **113*a*, 113*b*, and a can overfill or limit sensor valve 115. The stroke counter 112 is attached to the top cover 21 by sheet metal screws and extends through an opening 114 in the front portion of the top cover 21 to reveal its visual counter or register. The opening 114 in the top cover 21 preferably exists in the first and second embodiments, but is covered with a metal identification plate 117 held in place by four rivets. The shuttle valves 113*a*, 113*b* are mounted to the pneumatic cylinder 88**.

As best seen in FIG. 7, the limit sensor valve 115 is mounted within the base 10 on a mounting bracket 116. The limit sensor valve 115 is positioned adjacent the opening 30 in the base 10 such that the lower end of the platform shaft outer member 37 avoids engagement of the limit sensor valve 115 in the raised position but engages the limit sensor valve 115 when the platform shaft outer member 37 moves downwardly a predetermined amount. Two helical coil tension springs 120 downwardly extend from the lower end of the platform shaft outer member 37 to a flange at the bottom of the mounting bracket 116. The springs 120 downwardly bias the platform shaft 35 and overcome friction between the platform shaft outer member 37 and the limit sensor valve 115.

Figure 8:
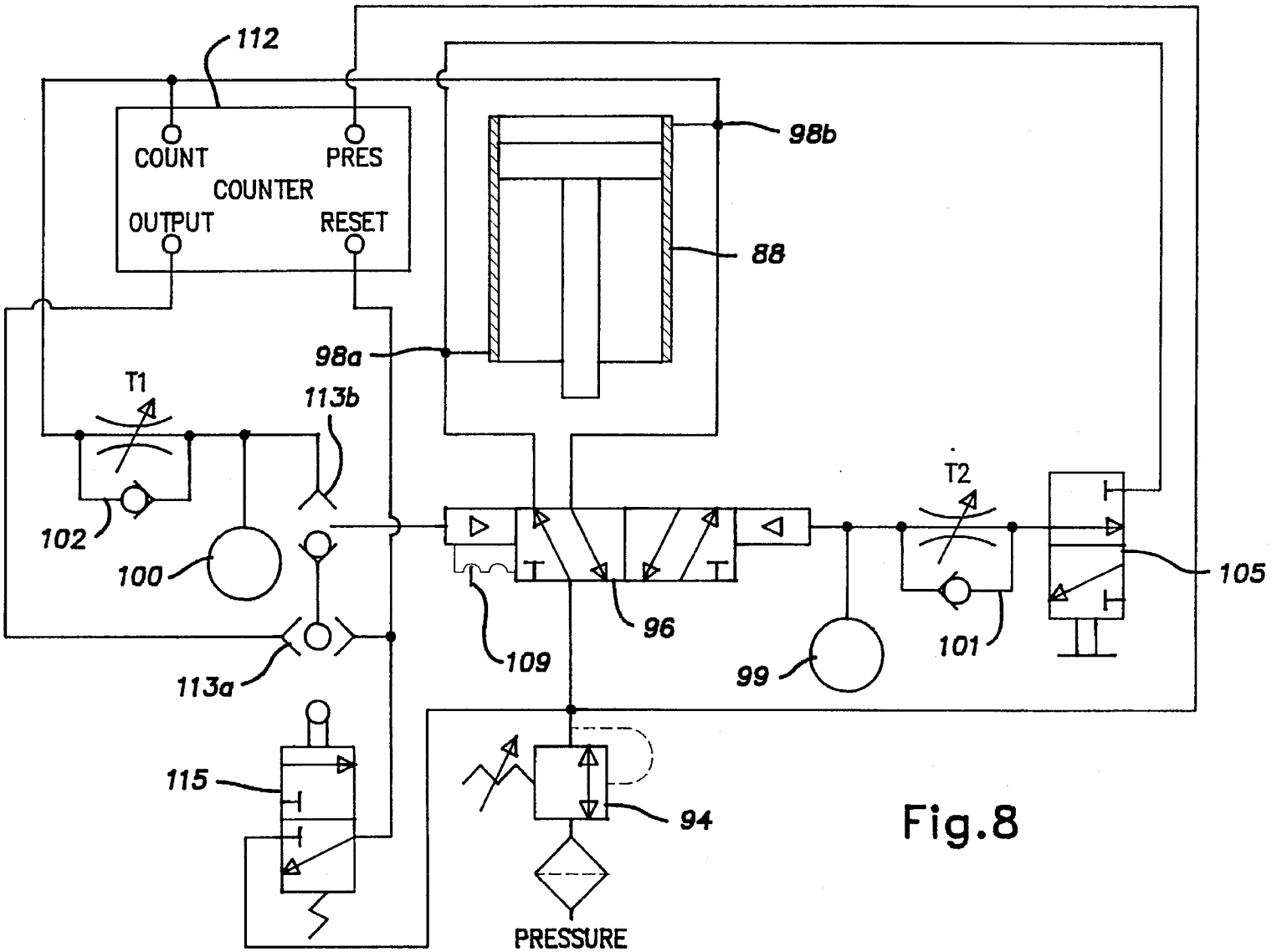
FIG. 8 is a diagrammatic illustration of a pneumatic circuit for the apparatus of FIG. 6.

A diagrammatic illustration of a pneumatic circuit for the apparatus 110 is shown in FIG. 8. The stroke counter 112 includes four ports: a supply or pressure port; a counter port; an output port; and a reset port. The pressure port is in direct communication with the regulator 94. The counter port is in communication with the air line connecting the second output of the control valve 96 with the second accumulator 100. The output port is in communication with the first shuttle valve **113*a*. The reset port is in communication with the output of the limit sensor valve 115. The output of the limit sensor valve 115 is also in communication with an input port of the first shuttle valve 113*a*. An input port of the limit sensor valve 115 is in communication with the regulator 94. An output port of the first shuttle valve 113***a* is in communication with an input port of the second shuttle valve 113*b*. The second shuttle valve also has an input port in communication with the second accumulator 100 and an output port in communication with the control valve 96.

To fill a pressurized can with paint, the reservoir is filled with paint, the can is positioned and raised, and the door is closed and secured as described above in connection with the apparatus 9 of FIG. 1. The piston 52 then cycles to drive the paint into the can as described above in connection with apparatus 86 of FIG. 4. However, the stroke counter 112 is set for a predetermined or selected number of piston strokes. As the piston 52 cycles, the stroke counter registers each down stroke. When the stroke counter registers zero, because the selected number of piston strokes has been completed, pressurized air is released from the stroke counter output port and travels through the shuttle valves 113*a*, 113*b* to the control valve 96. Because pressure is applied to both sides of the control valve 96, cycling of the piston 52 is stalled. Opening the door 22 shifts the safety valve 105 to interrupt communication between the first accumulator 99 and the first output of the control valve 96. Therefore, the control valve 96 shifts so that air is supplied to the lower space of the pneumatic cylinder 88 without cycling the piston. When the can support platform 31 is lowered, the platform shaft 35 engages and shifts the limit sensor valve 115 to reset the stroke counter 112.

If the can becomes overfilled at any time during the filling process, the can grows in the axial direction which downwardly moves the platform shaft 35. When the platform shaft outer member 37 engages and shifts the limit sensor valve 115, pressurized air travels through the shuttle valves 113*a*, 113*b* to the control valve 96. Because pressure is applied to both sides of the control valve 96, cycling of the piston 52 is stalled prior to rupture of the can.

Preferably, the apparatus 9 of FIG. 1 is adapted for upgrading to the apparatus 86 of FIG. 4 with a first upgrade kit providing the powered driving means 87. The first upgrade kit includes the regulator 94, the pneumatic cylinder 88, the accumulators 99, 100, the needle valves 101, 102, the safety/start valve 105 and all associated mounting hardware and tubing supplies. Therefore, the apparatus 9 of FIG. 1 preferably provides means for mounting or attaching the powered control means 82 such as preformed openings. The preformed openings include the regulator inlet opening 95 and associated screw holes, the needle valve openings 103, the accumulator mounting opening 104, and the safety/start valve mounting openings 108. Installation of the upgrade kit is eased by manufacturing the cabinet 11 with preformed openings matching the bolt patterns of the components in the upgrade kit. Additionally, the screw holes 81 in the upper support plate 17 are preferably dimensioned for mounting both the guide assembly 67 and the pneumatic cylinder 88. Furthermore, the threaded end of the pumping assembly piston 52 is dimensioned for attaching to both the lever assembly piston shaft 73 and the pneumatic cylinder piston rod 93.

The apparatus 9 of FIG. 1 and the apparatus 86 of FIG. 4 are preferably adapted for upgrading to the apparatus 110 of FIG. 6 with a second upgrade kit providing the automatic driving means 111. The second upgrade kit includes the stroke counter 112, the shuttle valves 113*a*, 113*b*, the limit sensor valve 115, and associated mounting hardware and tubing supplies. Therefore, the apparatus 9 of FIG. 1 and the apparatus 86 of FIG. 5 preferably provide means for mounting or attaching the automatic driving means 87, such as preformed openings. The preformed openings include the stroke counter opening 114 and associated screw holes. The apparatus 9 of FIG. 1 and the apparatus 86 of FIG. 3 also preferably include the identification plate 117 to cover the stroke counter opening 114. The identification plate 117 is attached to the front portion of the top cover 21 with pop rivets.

Although particular embodiments of the invention have been described in detail, it will be understood that the invention is not limited correspondingly in scope, but includes all changes and modifications coming within the spirit and terms of the claims appended hereto.

What is claimed is:

1. An apparatus for filling a pressurized can, said apparatus comprising:

a pumping assembly including a piston, a pumping chamber adapted for receiving said piston and having an outlet below said piston, and a reservoir, said outlet adapted for sealing engagement with said can, wherein said reservoir supplies liquid to said pumping chamber and said piston drives said liquid into said can;

a cabinet including three generally vertical walls formed of a single sheet enclosing the pumping assembly, said cabinet having a door providing access to the pumping assembly; and manual means for driving the piston of the pumping assembly to pump a selected amount of liquid into said can, said manual driving means including a grippable member external of said cabinet and supported by said cabinet and operatively connected by elements in said cabinet to said piston such that said piston translates within said pumping chamber by forces developed through said grippable member and sustained by said cabinet walls.

2. The apparatus as set forth in claim 1, wherein said elements include a crank arm pivotally supported on said cabinet.

3. The apparatus as set forth in claim 1, wherein said cabinet has internal means for mounting powered means for driving the pumping assembly.

4. The apparatus as set forth in claim 3, wherein said cabinet has internal means for mounting automatic means for driving the pumping assembly.

5. The apparatus as set forth in claim 4, wherein said automatic driving means includes a stroke counter, said mounting means includes an opening in said cabinet for said stroke counter, and said cabinet includes a cover plate removably attached to said cabinet and covering said stroke counter opening.

6. An apparatus for filling a pressurized can, said apparatus comprising:

a pumping assembly including a piston, a pumping chamber adapted for receiving said piston and having an outlet below said piston, and a reservoir, said outlet adapted for sealing engagement with said can, wherein said reservoir supplies liquid to said pumping chamber and said piston drives said liquid into said can;

a cabinet enclosing the pumping assembly, said cabinet having a door providing access to the pumping assembly;

manual means for driving the piston of the pumping assembly to pump a selected amount of liquid into said can, said manual driving means including a grippable member supported by said cabinet and operatively connected to said piston such that said piston translates within said pumping chamber by forces developed through said grippable member, a can support for receiving a bottom of the can and means for manually elevating the can support between a lowered position and a raised position, said can engaging said pumping chamber outlet in said raised position, said elevating means including an eccentric cam engaging said can support and mounted on a generally horizontal rotatable shaft.

7. An apparatus for filling a pressurized can, said apparatus comprising:

a pumping assembly including a piston, a pumping chamber adapted for receiving said piston and having an outlet below said piston, and a reservoir, said outlet adapted for sealing engagement with said can, wherein said reservoir supplies liquid to said pumping chamber and said piston drives said liquid into said can;

a cabinet enclosing the pumping assembly, said cabinet having a door providing access to the pumping assembly;

manual means for driving the piston of the assembly to pump a selected amount of liquid into said can, said manual driving means including a grippable member supported by said cabinet and operatively connected to said piston such that said piston translates within said pumping chamber by forces developed through said grippable member, a can support for receiving a bottom of the can and means for manually elevating the can support between a lowered position and a raised position, said can engaging said pumping chamber outlet in said raised position, and a mechanical interlock preventing said door from closing when said can support is in said lowered position.

8. The apparatus as set forth in claim 7, wherein said mechanical interlock includes a finger inwardly extending from said door, said finger engaging said can support in said lowered position and avoiding engagement of said can support in said raised position.

9. An apparatus for filling a pressurized can, said apparatus comprising:

a pumping assembly including a piston, a pumping chamber adapted for receiving said piston and having an outlet below said piston, and a reservoir, said outlet adapted for sealing engagement with said can, wherein said reservoir supplies liquid to said pumping chamber and said piston drives said liquid into said can;

a cabinet enclosing the pumping assembly, said cabinet having a door providing access to the pumping assembly;

manual means for driving the piston of the pumping assembly to pump a selected amount of liquid into said can, said manual driving means including a grippable member supported by said cabinet and operatively connected to said piston such that said piston translates within said pumping chamber by forces developed through said grippable member, said manual driving means including a lever assembly having a shaft rotatably supported generally at each end by walls of said cabinet, said lever assembly including an arm attached to said shaft and providing said grippable member for rotating said shaft on a longitudinal axis of said shaft, said lever assembly also including a connector are fixed generally perpendicular to said shaft, a piston shaft fixed to said piston, and a linkage assembly for connecting said connector arm to said piston shaft such that said piston translates within said pumping chamber as said lever assembly shaft rotates.

10. The apparatus as set forth in claim 9, wherein said lever assembly further includes a guide having a bore and being supported by said cabinet, said piston shaft extending through said bore for guiding said piston shaft generally coaxially with said pumping chamber.

11. An apparatus for filling a pressurized can, said apparatus comprising:

a pumping assembly including a piston, a pumping chamber adapted for receiving said piston and having an outlet, and a reservoir for supplying liquid to said pumping chamber, said outlet adapted for sealing engagement with said can and said piston adapted for driving said liquid into said can;

a cabinet enclosing the pumping assembly, said cabinet having a door providing access to the pumping assembly; and powered means for driving the pumping assembly to pump a selected amount of liquid into said can, said powered driving means including a pneumatic cylinder having a piston and a piston rod connected to said piston, said piston rod being generally coaxial with and connected to said pumping assembly piston, and a pneumatic circuit with at least one accumulator for alternately causing said driving means piston to move up and down at a predetermined rate regulated with said at least one accumulator.

12. The apparatus as set forth in claim 11, wherein said powered driving means includes at least one needle valve for throttling flow to said accumulator.

13. The apparatus as set forth in claim 11, wherein said door has a latch and said powered driving means includes a safety/start valve, said latch triggering said safety/start valve when said door is closed to permit cycling of said piston.

14. The apparatus as set forth in claim 11, wherein said cabinet has means for mounting automatic means for driving the pumping assembly.

15. The apparatus as set forth in claim 14, wherein said automatic driving means includes a stroke counter, said mounting means includes an opening in said cabinet for said stroke counter, and said cabinet includes a cover plate removably attached to said cabinet and covering said stroke counter opening.

16. The apparatus as set forth in claim 11, further comprising automatic means for driving the pumping assembly including a stroke counter in communication with said control valve and a shut-off valve, wherein said stroke counter triggers said shut-off valve to stop cycling of said piston when a predetermined number of strokes is counted by said stroke counter.

17. An apparatus for filling a pressurized can, said apparatus comprising:

a frame formed of a sheet metal cabinet;

a pumping assembly within said cabinet frame including a piston, a pumping chamber adapted for receiving said piston and having an outlet below said piston, and a reservoir for supplying liquid to said pumping chamber, said outlet adapted to be in sealing engagement with said can while said piston drives said liquid into said can; and manual means and powered means, interchangeably mountable on said cabinet frame, for driving the pumping means to pump a selected amount of liquid into said can, said cabinet frame having means for mounting at least a portion of said manual driving means or said powered driving means within said cabinet frame, said manual driving means including a grippable member supported by said cabinet frame outside of said cabinet frame and operatively connected to said piston such that said piston translates within said pumping chamber by forces developed through said grippable member.

18. The apparatus as set forth in claim 17, further comprising automatic means, interchangeably mountable on said frame, for driving the pumping means, said frame having means for mounting said automatic control means thereto.

19. An apparatus for filling a pressurized can, said apparatus comprising:

a frame formed of a sheet metal cabinet;

a pumping assembly within said cabinet frame including a piston, a pumping chamber adapted for receiving said piston and having an outlet below said piston, and a reservoir for supplying liquid to said pumping chamber, said outlet adapted to be in sealing engagement with said can while said piston drives said liquid into said can;

manual means, mounted on said cabinet frame and having a portion within said cabinet frame, for driving the pumping means to pump a selected amount of liquid into said can, said manual driving means including a grippable member supported by said cabinet frame outside of said cabinet frame and operatively connected to said piston in said cabinet frame such that said piston translates within said pumping chamber through forces developed through said grippable member, said cabinet frame having means for mounting said manual driving means thereto; and a kit for upgrading said apparatus including a pneumatic cylinder to be mounted in said cabinet frame for driving said pumping means and means for cycling said pneumatic cylinder, said cabinet frame having means for mounting said pneumatic cylinder and said cycling means thereto.

20. The apparatus of claim 19, wherein said cycling means includes a pneumatic circuit with at least one accumulator for alternately causing said driving means piston to move up and down at a predetermined rate.

21. The apparatus of claim 19, wherein said kit includes a stroke counter for counting the number of piston cycles and a shut-off valve for stopping cycling of said piston when said stroke counter counts a predetermined number of piston cycles.

* * * * *